United States Patent [19]

Dollat

[11] 4,002,044

[45] Jan. 11, 1977

[54] YARN STOP MOTION

[75] Inventor: Michel Paul Dollat, Le Cheylard, France

[73] Assignee: Establissements A. Chromarat & Cie, Paris, France

[22] Filed: Dec. 2, 1974

[21] Appl. No.: 528,859

[30] Foreign Application Priority Data

Dec. 18, 1973 France ..... 73.45399
Oct. 4, 1974 France ..... 74.33607

[52] U.S. Cl. ..... 66/161; 200/61.13
[51] Int. Cl.[2] ..... D04B 35/12
[58] Field of Search ..... 66/161, 163, 132 R, 66/125 R; 200/61.13, 61.18

[56] References Cited

UNITED STATES PATENTS

| | | | |
|---|---|---|---|
| 3,419,225 | 12/1968 | Rosen | 66/132 T |
| 3,580,012 | 5/1971 | Voisin | 66/132 X |
| 3,677,036 | 7/1972 | Hatay | 66/132 R |
| 3,748,414 | 7/1973 | Holm | 200/61.13 |
| 3,791,599 | 2/1974 | Jacobsson | 66/132 T |
| 3,807,199 | 4/1974 | Rosen | 66/163 |
| 3,851,501 | 12/1974 | Levin et al. | 66/163 |
| 3,858,416 | 1/1975 | White et al. | 66/132 R |

*Primary Examiner*—Mervin Stein
*Assistant Examiner*—Andrew M. Falik
*Attorney, Agent, or Firm*—Stevens, Davis, Miller & Mosher

[57] ABSTRACT

A process and apparatus for continuously supplying a textile machine, such as a circular knitting machine, with yarn under constant tension, the yarn being stored transiently and continuously in optimum amount on a negative feed drum type storage feeder, wherein when excessive tension arises during feeding lasting for only a short period (for example 3/10ths of a second) the restoring mode of the feed device is stopped whereby the existing supply of yarn on the drum will be fed to the needles. Additionally, when said excessive tension lasts for a period longer than the above short limit but at most equal to a middle limit (for example 3 to 30 seconds) the machine is temporarily stopped. In both cases reactivation of the feed drum so that the yarn can be restored to its optimum amount and restarting of the machine automatically occurs if the excessive tension is eliminated within the above time periods. If however the middle limit is exceeded due to a feed problem which is not self correcting, the machine remains stopped until an operator intervenes to remedy the problem.

5 Claims, 9 Drawing Figures

FIG. 1
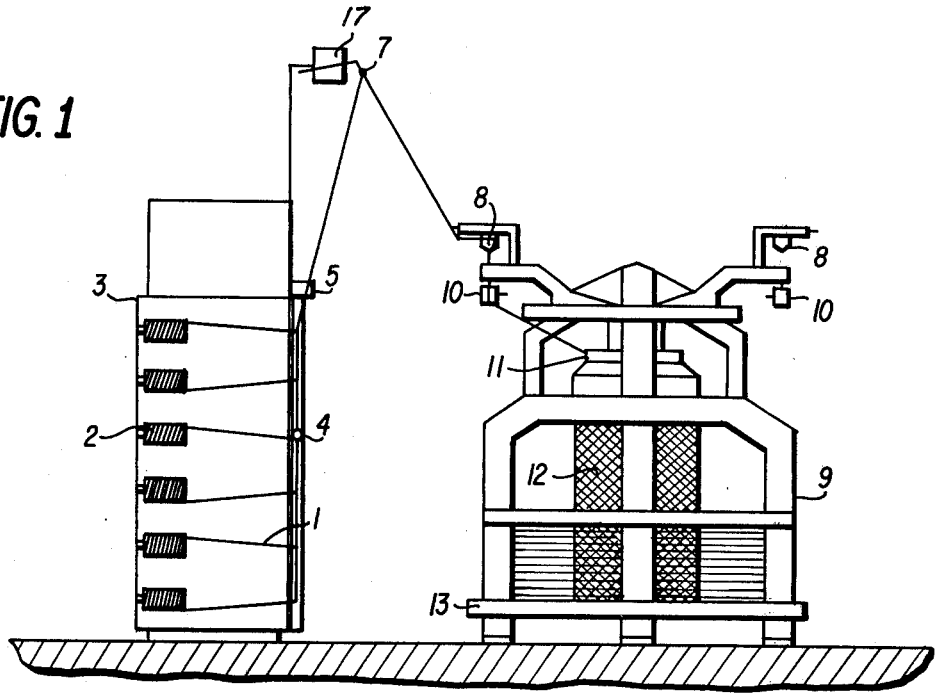
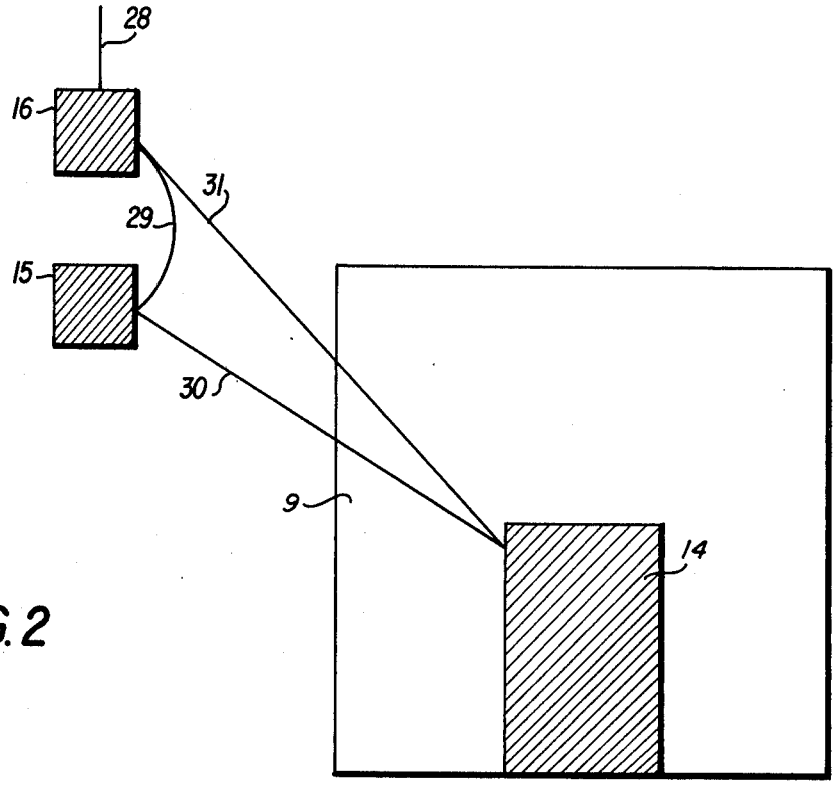
FIG. 2

YARN STOP MOTION

It is well known that a textile machine, such as, for example, a circular knitting machine must be supplied under very constant tension with yarn which unwinds from suitable supports such as cones, bobbins and the like. If this is not the case, the textile article manufactured possesses defects (scores, bars, looped yarns and the like), which make it difficult to sell and may even cause it to be rejected. Very frequently the yarns do not unwind evenly from the supports in question and give rise to sudden changes in tension, because they are jammed, embedded or possess structural defects which make them catch onto one another during the unwinding process, and the like.

It is true that these disadvantages have been overcome to a certain extent by placing tension smoothing apparatus in the path of the yarns, between their supports and the textile machine fashioning them, the precise function of such tension smoothing apparatus being to absorb the unevennesses in tension generated as the yarns are unwound, in order to make it possible for the textile machine to be supplied with yarns under constant tension. French Pat. Nos. 1,345,166, 1,550,026, 1,589,997 and 1,593,374, inter alia, describe such means. In general terms, these means consist of rotating components which are controlled independently of the textile machine, are interposed between the supports and this machine, and on which there is continuously stored a certain optimum yarn reserve coming from the supports which is discharged continuously into the machine. It is thus a very small amount of yarn which is continuously supplied and used. In a case of excessive tension of the yarn, there is a fault in the supply of yarn to the rotating component of the feed device, but the latter continues nonetheless temporarily to discharge yarn to the machine, by drawing on its reserve. Thereafter, when the fault has been corrected and when normal working conditions have been resumed, the rotating component of the feed device is again supplied with the optimum amount and the original conditions apply once more. Thus, the machine is protected from sudden changes in tension of the yarn during the unwinding process since these sudden changes in tension are compensated for by the smoothing device in question.

One of the disadvantages of such devices resides in the fact that the slightest excessive tension during the unwinding of the yarn causes total stoppage of the installation, both of the textile machine itself and of the rotating component of the feed device storing the yarn reserve. It is only when the fault in the steady supply of yarn from its support has been corrected, as a result of manual intervention by the operator, that it is possible to again start both the intermediate rotating component of the feed device (often simply called the "feed device") and the textile machine itself. All this results in a loss of time, a lowering of the productivity of the machine, excessive consumption of energy in starting the moving parts, quite considerable fatigue for the operator, and the like.

SUMMARY OF THE INVENTION

The purpose of the present invention is essentially to restrict the manual intervention operations to those cases where intervention is really necessary, and consequently to increase the productivity of the combination, to reduce the work of personnel, and the like, and to do all this, of course, without in any way affecting the quality of the textile article to be formed.

The process according to the invention is based on the observation that:

In a large number of cases, the excessive tensions which arise while the yarn is being unwound from its support are of very low intensity, and consequently require an extremely short period of time, less than a limit hereafter called the "short limit", for them to be overcome by a given force, and hence it is not necessary to stop the operation of the textile machine which derives its supply from the yarn reserve of the rotating component of the feed device, which is started again automatically when the excessive tension has ceased and reforms its reserve. In another substantial proportion of cases, although the excessive tensions are of somewhat greater magnitude, they can in their turn be overcome, still for a given force, before the end of a slightly longer period of time, hereafter called the "middle period of time", so that, over the period exceeding the short limit, the textile machine also ceases to operate so that it does not empty the reserve of the feed device, the textile machine, like the rotating component of the feed device, being started again automatically when the excessive tension during the unwinding process has been overcome. Finally, in the small number of remaining cases, comprising very great excessive tensions of yarn during the unwinding process, serious cases of yarns being caught on one another, breakage of the yarn and the like, the moving parts are allowed to stop and the necessary manual interventions are made before starting the combination again when desired, doing so in a gradual manner, as is necessary.

In other words, this process for continuously supplying a textile machine, such as a circular knitting machine, with yarn under constant tension, the said yarn being stored transiently, also continuously and in optimum amount, is characterized in that, in a case of excessive tension arising while the yarn is being unwound and lasting for a period at most equal to the short limit (for example 3/10ths of a second), the store of yarn ceases to be maintained at its optimum amount, and that, in a case of excessive tension which lasts for a period longer than the above but at most equal to the middle limit (for example 3 to 30 seconds), in addition the machine ceases to be supplied with yarn, the restoring of the yarn to its optimum amount and indeed the re-supplying of the machine with yarn being resumed as soon as the excessive tension during unwinding has been overcome.

It is not possible to give exact figures for the values of the short limit and the middle limit, these elements depending on numerous factors such as, especially, the nature, gauge and presentation of the yarn, the speed of the textile machine and the size of the yarn reserve on the feed device. It can be stated, however, that in the most common cases, the short limit can be 3/10ths of a second and the middle limit at least 3 seconds and preferably approximately between 5 and 30 seconds.

A device for carrying out this process, suitable for circular knitting machines equipped with feed devices including a rotating component which stores an optimum yarn reserve which is continuously discharged, positioned between the yarn support and the machine, comprises:

A first micro-contact-breaker with a delayed action, which, should excessive tension of the yarn arise during the unwinding process and last for a period at most equal to the short limit, is actuated by the yarn under excessive tension and stops the controls of the movement of the rotating component (feed device), while the inertia forces of this rotating component succeed in overcoming the excessive tension force; when this micro-contact-breaker is no longer subject to the action of the yarn, it then again starts the controls of the movement of the rotating component (feed device) which again builds up the store of yarn to its optimum reserve; and A second micro-contact-breaker with a delayed action, which, in a case of excessive tension of the yarn lasting for a period between the short limit and the middle limit, is actuated by the yarn and stops the controls of the knitting machine, the yarn reserve stored on the feed device being sufficient to supply the machine; as above, when this micro-contact-breaker is no longer subject to the action of the yarn under excessive tension, it again starts the controls of the movement of the machine.

An improved knitting machine, of the type comprising a supply bobbin-carrying creel, a rotating component acting as a yarn feed device possessing a reserve, supplying the yarn to the knitting head, a component for controlling the rotational movement of the feed devices, a component for controlling the knitting head, and a micro-contact-breaker with a delayed action situated between the creel and the feed devices and connected to the components for controlling the rotational movement of the feed devices and the movement of the knitting head, is characterized in that the micro-contact-breaker consists of:

A micro-contact which successively controls the stopping of the component for controlling the rotational movement of the feed devices and the stopping of the component for controlling the movement of the knitting head;

an arm which moves about a fixed axis, carrying at one free end a guide through which the yarn passes; and means for transmitting the oscillations of the arm to the micro-contact.

BRIEF DESCRIPTION OF THE DRAWING

The way in which the invention can be carried out and the advantages which result therefrom will become more apparent from the example embodiment which follows and which is given by way of illustration and without implying a limitation, with reference to the attached drawings.

FIG. 1 shows, in cross-section and diagrammatically, a circular knitting machine which operates according to the invention.

FIG. 2 concisely represents the electrical system for controlling such a machine.

DETAILED DESCRIPTION

Figure 3:
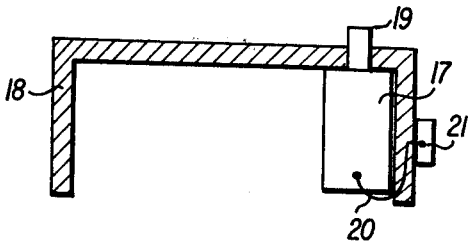
FIGS. 3 and 4 illustrate a micro-contact-breaker according to the invention.

The yarn to be knitting 1 (see FIG. 1) unwinds off the end of a bobbin-support 2 placed on a creel 3 positioned on the ground, passes through a conventional tensioning device 4 comprising discs, and then optionally passes through a monitor 5 which detects the presence of yarn, for example of the TRIPLITE type. The path of only one yarn has been represented in FIG. 1, it being understood that on a machine there are as many devices according to the invention as there are feeders. Likewise, only one creel 3 has been represented, but, depending on the type of machine, this creel can be formed from several separate parts surrounding the machine or from a single combination carried by the top of the machine (umbrella creel). The optional yarn detector 5 which checks for the presence of the yarn and, in its absence, causes the machine to stop by acting on the control box 14, can be placed either before or after the feed device 8; however, the safety of the combination is improved by placing it on the creel 3.

Figure 4:
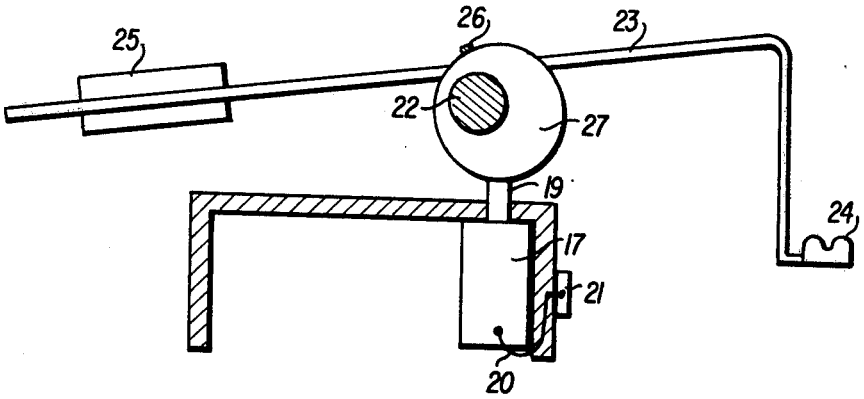

On issuing from the detector 5, the yarn is conveyed on the arm 7 of the micro-contact-breaker 17 (see FIGS. 3 and 4), and then reaches the feed device 8 which is placed above the circular knitting machine 9. There is always one feed device per feeder, for example 48 feed devices for a machine with 48 feeders. This feed device is of a type which is in itself known, for storing the yarn in an intermediate position, temporarily and continuously. A negative feed device of the SFS type, constructed by AB-IRO, P.O. Box 54, 52301 Ulriceham, Sweden, is preferably used, in which the stop function due to excessive tension has been removed by locking the appropriate screw. Such a feed device is described in the patents mentioned in the introduction.

On leaving the feed device 8, the yarn to be knitted then optionally passes through a positive feed device 10, for example of the type with belts, which operates at a constant rate (feed device of the BF type supplied by AB-IRO), and then reaches the knitting head 11 which forms the tubular fabric 12 which is taken up at 13 in a known manner.

The frame of the knitting machine 9 carries (see FIG. 2) an electrical panel 14 for controlling the various functions of the knitting machine (stopping, operating at low speed and operating at normal speed).

This panel 14 is connected by electric wires (see FIG. 5) first to the panel 15 which controls the feed devices 8 and which is placed, for example, on the creel 3 or on the machine 9 itself, and second to the panel 16 which controls the automatic operations (such as starting of feed devices and/or the knitting machine, starting of the machine at a slow speed then fast) and then if the over-tension exceeds the middle period of time, panel 16 prohibits the automatic starting of the machine.

The micro-contact-breaker 17 (see FIGS. 3 and 4) is of the type X 1 P 20 supplied by CEM (Compagnie Electro-Mecanique, 210, Avenue Felix-Faure, 69003 Lyon, France). This micro-contact-breaker 17, which acts for a single yarn position, is mounted on a U-shaped aluminum crossbar 18 placed on top of the creel 3, and possesses a push-button 19 which passes through a hole in the crossbar 18. This micro-contact-breaker 17 is connected by an electric wire 20 to a luminous indicator 21 which, should the machine stop, indicates the position at which the operator must intervene.

A fixed shaft 22, for example made of steel, is placed above the push-button 19 of each position and parallel to the crossbar 18.

A brass arm 23 (FIG. 4) carries, at one end, a yarn-guide 24, for example made of sintered ceramic, and, at its other end, a counterweight 25 which can slide on the arm 23. This arm 23 is fixed by means of a screw 26 to an eccentric cam 27, for example made of stainless steel, mounted loose about the fixed shaft 22 and held in position on the latter by circlips which are not represented, placed on either side of the shaft 22. The profile of the cam 27 is calculated so that, in a first stage, when there are normal excessive tensions during the unwinding process, the arm 23 can cause the cam to rotate about the fixed shaft 22 without engaging the push-button 19, and so that, in a second stage, the cam engages the push-button 19 when the movement of the arm 23 caused by the pressure of the yarn on the yarn-guide 24 reaches a pre-determined threshold.

Figure 5:
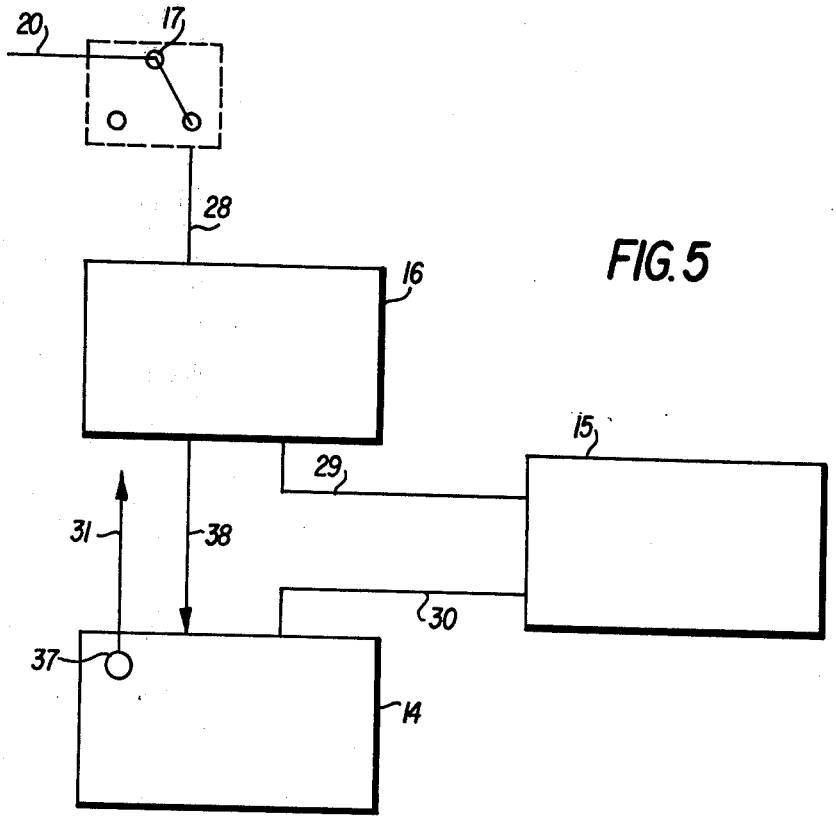
FIG. 5 shows the circuit diagram for controlling the various control components.
Figure 7:
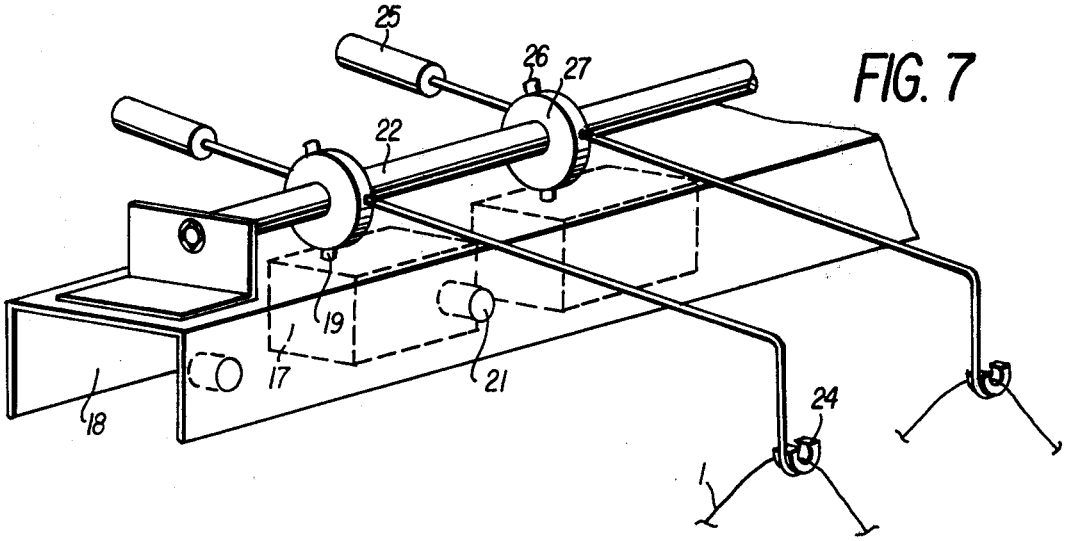
FIG. 7 shows the elements of FIG. 4, in perspective.

The micro-contact 17 of the micro-contact-breaker 6 is connected by an electric wire 28 to the box 16 which controls the delaying operations and which is placed, as already stated, on the creel 3 (see FIG. 5). This control box 16 is connected in turn first by the wire 29 to the box 15 which controls the feed devices, and second by the wire 31 to the box 14 which controls the machine. The box 15 which controls the feed devices is connected by a wire 30 to the box 14 which controls the machine.

Figure 6:
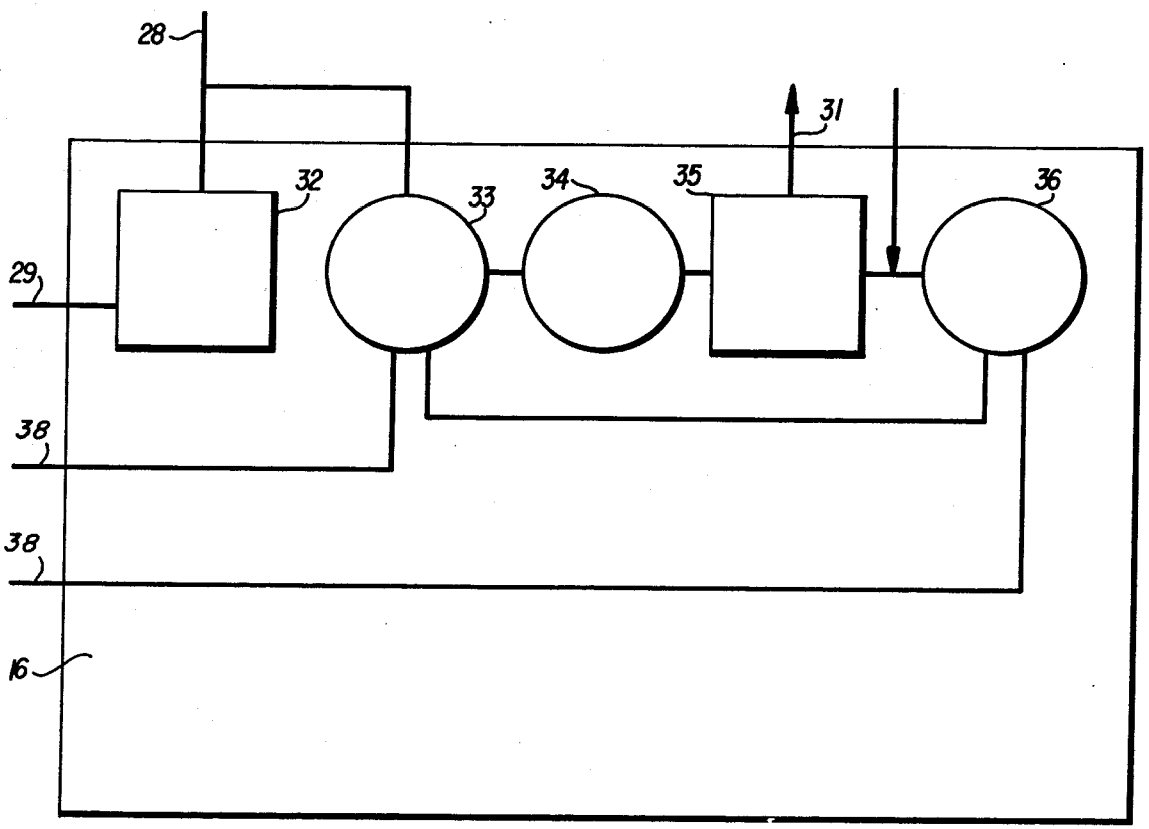
FIG. 6 is a diagrammatic representation of the elements for controlling the various control components.

The delaying action panel 16 (FIG. 6) consists of:

A contactor 32, of the type KOS-8/40 (24-50) supplied by CEM, 210, Avenue Felix-Faure, 69003, Lyon, France, connected first by the wire 28 to the micro-contact 17, and second by the wire 29 to the box 15 which controls the feed devices, this contactor being intended to stop the feed devices 8 by acting on the control box 15;

an element with a delaying action 33, for cases of excessive tension lasting for a short period (TPA type supplied by CEM, 210, Avenue Felix-Faure, 69003 Lyon, France, for KOS-8), associated with a contactor which is not represented, the said element with a delaying action being adjusted to control, after a period of time equal to the short limit chosen, for example 3/10ths of a second, the lag between the stopping of the feed devices 8 and that of the knitting machine 9; this element is chosen, nevertheless, so that, after several stoppages (4 or 5) caused by excessive tensions lasting for a short period, a small amount of yarn still remains on the drum of the feed devices 8;

a second element with a delaying action 34, in series with 33, of the same type as the latter, intended to control the final stopping of the machine 9 after a period of time equal to the optimum limit, for example 25 seconds, by acting through the memory 35 on the box 14 which controls the machine; a transistorized memory block 35, of the AMA type, for a contactor of the KOS-8 type supplied by CEM, 210, Avenue Felix-Faure, 69003 Lyon, France, with its contactor which is not represented; and a third element with a delaying action 36, also connected to a contactor which is not represented, intended to start up the machine, connected firstly to the element with a delaying action 33 and secondly to the box 14 which controls the machine.

The box 14 which controls the machine finally carries a contact 37 which makes it possible to free the memory and which acts on the latter via the conducting wire. In a practical embodiment, this contact 37 can be the control button for starting slow operation.

The device described operates in the following general way:

If excessive tension develops during the unwinding process, the yarn, stretched in the micro-contact breaker 17, causes the controls of the rotating component of the feed device 8 storing the yarn reserve to be stopped (in fact, for practical reasons, the controls of all the feed devices are stopped at the same time). If the excessive tension is overcome by the movement inertia of the rotating component of the feed device within less than 3/10ths of a second, the controls of this component are re-established immediately, and this component immediately re-supplies itself, until the optimum reserve is reached, with a very small amount of yarn unwound from this component, because the machine has not ceased to operate.

If, on the other hand, overcoming the excessive tension during the unwinding of the yarn 1 requires more than 3/10ths of a second, but less than 25 seconds, the following occurs:

During the first period, that is to say up to 3/10ths of a second, the controls of the rotating component of the feed device 8 are stopped, as above. Thereafter, during the second period, that is to say between 3/10ths of a second and 25 seconds, the element with a delaying effect 16 comes into play and causes the controls of the machine to be stopped. Once again, when the excessive tension which has arisen during the unwinding of the yarn 1 has been absorbed by the rotating component of the feed device, the controls are re-established, the moving parts return to their normal speeds, the yarn reserve on the rotating component of the feed device has not been completely depleted because the controls of the machine have been stopped, and the feed device re-supplies itself until the optimum amount is reached.

If, finally, the excessive tension has not been overcome after 25 seconds (or if some other fault has arisen which makes it impossible to normally supply the machine with yarn), the element with a delaying action 34 comes into effect and locks the machine, and the operator has to intervene in order to remedy the failure. After this has been done and after the memory block 14 and the sequential system for effecting gradual starting-up have been employed, the whole returns to normal operation.

The device operates in the following detailed way.

If the tension on the yarn 1 which unwinds and passes through the yarn-guide 24 is normal, the arm 23 is at rest and the knitting machine 9 operates normally.

Figure 4A:
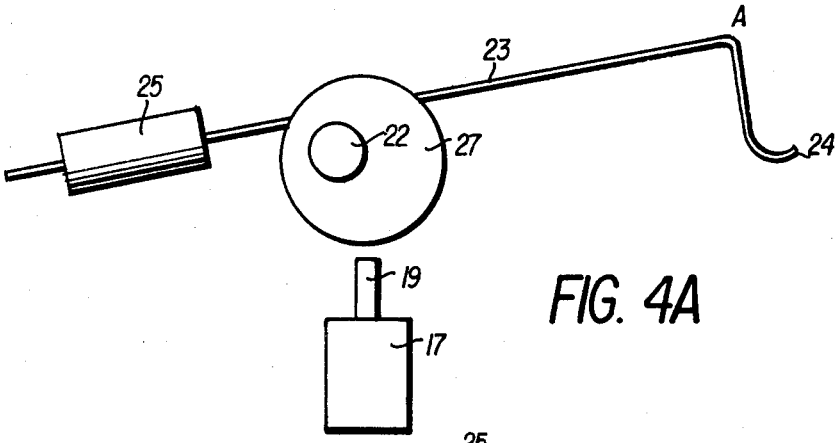
FIGS. 4A–4C schematically illustrate positions A, B and C of arm 23.
Figure 4B:
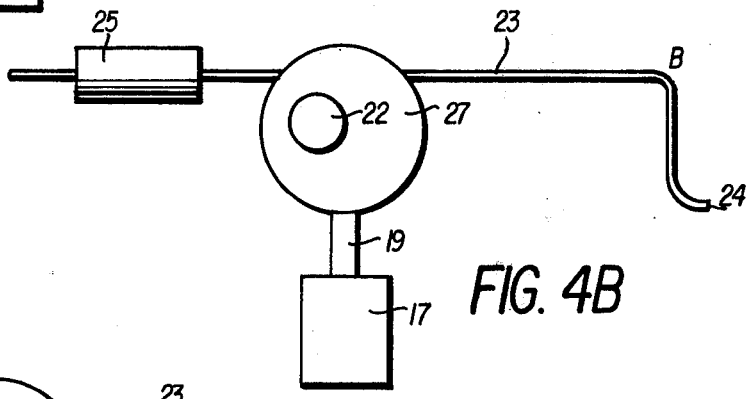
Figure 4C:
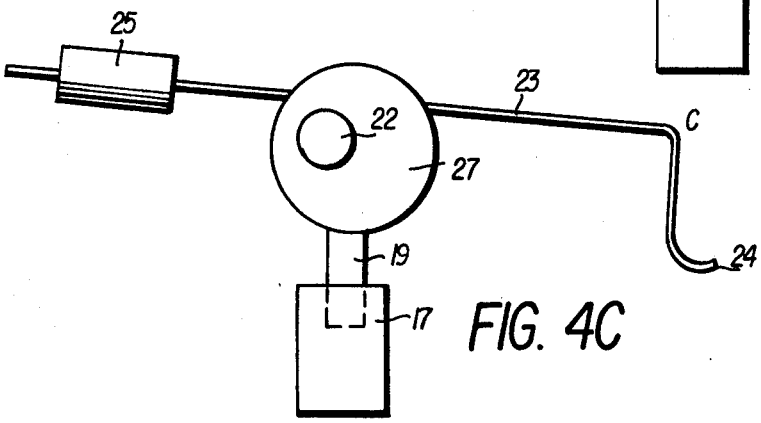

If, during the unwinding process, the yarn is subject to certain variations in tension — for example, variation due to starting-up or at the end of forming a coil on the feed device — the balancing device 23 oscillates from a position A (see FIGS. 4A–4C) to a position B, corresponding to variations in tension which are normal and acceptable during the unwinding process, the position B being such that the rocking movement of the arm 23 driving the cam 27 does not act on the push-button 19 (approach path). In this case also, the push-button 19 is not actuated and the machine 9 continues to rotate.

If excessive tension develops (yarn caught, jumbled yarn, knot or the like), the arm 23 passes beyond the position B and reaches a position C (attack path) such that the cam 27 moves until it operates the push-button 19 and thus engages the micro-contact 17. The indicator 21 lights up and the information is transmitted to the control box with a delaying effect 16. The contactor 32 opens and triggers the stopping of the corresponding feed device 8 by acting on the box 15 which controls the feed device. The machine 9 continues to rotate, taking the yarn stored on the reserve of the drum of the feed device 8. If, during this period, the excessive tension disappears, the contactor 32 closes and this controls the starting-up of the feed devices 8, re-establishes the circuit with 15 and the machine resumes normal operation.

If, on the other hand, the excessive tension persists beyond the limiting threshold fixed for the element with a delaying effect 33, for example 3/10ths of a second, 33 actuates the other element 34 and the contactor (not shown) of memory 35 closes and gives the machine 11 the automatic non-starting order via the cable 31.

If, at this stage, the excessive tension still persists and reaches the maximum threshold fixed, for example 25 seconds, the memory 35 remains held in position and, via 31 and 14, gives the machine 9 the order not to start up automatically. The luminous indicator 21 being lighted and the machine being stopped, the operator can intervene directly at the position in question and can carry out the repair manually. Once this has been effected and the excessive tension has been eliminated, the operator frees the memory by acting on the button 37 and the cycle is returned to zero. The machine starts up at slow speed and then assumes normal speed and automatic operation comes into force. If, however, the excessive tension only lasts for a period of time between the low limit (3/10ths of a second) and the high limit (25 seconds) and frees itself within this period of time, the push member 19 is engaged, which causes the opening of the contactor 32 which then acts on the timing element 33 and the latter in its turn acts on the timing element 36 thus causing the stopping of the machine 11 via the cable 38. If the excess tension disappears before the upper limit (25 seconds) the contactor 32 closes and acts on 33 and 36. The latter in its turn acts to control the automatic placing in operation of the machine 11 via 38 which acts on 14. As a result, this causes the starting of the feed devices 8 by the action of the contactor 32 on the box 15.

If, in exceptional cases, the path of the arm 23 passes beyond the threshold C defined above, the excessive tension which is the cause of this excess is damped by the residual path between the push-button 19 and the profile of the cam 27.

As already stated, the profile of the cam 27, and particularly the profile of the respective proportions corresponding to the approach, attack and residual paths, is calculated as a function, especially, of the values employed for these paths and the nature of the yarns being worked. If the yarn 1 is very fragile, the approach path, and likewise the attack path, will be as low as possible, and the residual path will have the maximum value in order to reduce the inertia effect of the feed device 8 on the yarn. On the other hand, if the yarn 1 is strong (for example, in the case of a polyester yarn texturized by false twist and refixed), the approach, attack and residual paths will have average values.

In an improved embodiment which is not illustrated, a programming device is placed on the direct path 38 between the element with a delaying effect 36 and the box 14 which controls the machine. This programming device is formed from three cams which control respectively the stopping and starting-up again of the machine, and the slow speed and the normal speed of the knitting machine.

With some light or fragile yarns, the inertia of the feed devices 8 is too great relative to the excessive tensions which this yarn could withstand. In order to avoid breaking it and in order to give the machine more flexibility, it is possible either to change the weight of the drum of the feed devices or to equip them with a braking-locking system or no longer to control them individually but in a general way which is independent of the machine, and consequently to make these feed devices work in accordance with the tensions recorded.

The invention possesses numerous advantages relative to the knitting techniques which have hitherto been in general use. All other things being equal, it has been found that, for the same circular knitting machine, the device according to the invention improved the productivity by at least 15%, and even 20% and more, relative to the same machine without a feed device 8, and by at least 5% and preferably 8% and even 10% and more relative to the same machine with feed devices without additional equipment.

It is even to be noted that, according to the invention, the improvement in productivity is the more marked, the poorer the quality of the yarn.

Moreover, in industry, the same operator can be in charge respectively of six standard circular knitting machines without a feed device, eight machines of the same type with a feed device and finally eleven machines equipped according to the invention.

Furthermore, and this point is important, the fatigue of the personnel is considerably reduced since their need to intervene is much less.

Finally, by way of comparison, the same amount of polyester yarn texturized by false twist and refixed from the same defective batch was treated on the same circular knitting machine equipped first with feed devices, and second according to the invention. In the first case, it was found that the operator had to intervene in the case of two hundred and twenty stoppages of the machine. In the second case, it was found that the machine stopped only four times, all the other excessive tensions having caused momentary stoppages, the starting again of the machine having been effected automatically without breaking the yarn.

The invention is particularly suitable for circular knitting machines, but it can be adapted to other textile devices in which it is desired to control the tension of the yarn during treatment.

What is claimed is:

1. A knitting machine which is continuously fed with a yarn under constant tension, comprising:

a yarn supply (2,3);

a knitting head (11);

a rotatable reserve negative feed device (8) mounted on the frame of the knitting machine and across which the yarn feeding the knitting head passes under substantially constant tension;

means for winding (13) up the knitted goods produced;

a first drive means including an electrical panel (15) for the stopping and operating movement of the knitting head and the winding means, said first drive means being connected to the winding means;

a yarn guide (7), located between the yarn supply and the feed device, over which the unwinding yarn passes;

a second drive means including an electrical panel (16) for the automatic starting and operating functions of the different movable elements of the knitting machine, said second drive means being connected to the means for rotating the feed device and to the first drive means;

means including a micro-contact (17) located in the vicinity of the guide, for transmitting to the second drive means the excess tensions of the yarn passing over the guide;

wherein said second drive means comprises:

a contactor (32) connected to the micro-contact and to the means for rotating the feed devices, for controlling the stopping and the operation of the movement of rotation of the feed device;

a first timing element (33) connected to the contactor and to the first drive means for, when the contactor is actuated, stopping the movement of rotation of the knitting head after a period of time at least equal to a predetermined short limit;

a second timing element (34) connected to the first timing element, for preventing the automatic restarting of the machine after a period of time at least equal to a predetermined upper limit, a third timing element (36) connected to the first and second timing elements and to the first drive means for actuating rotation of the machine when the contactor returns to its initial position.

2. A knitting machine according to claim 1, additionally comprising a memory block (35) operatively connected between the second and third timing elements, for preventing restarting of the machine when, at any of the working positions, there is excess tension in the yarn feeding the knitting head.

3. A knitting machine according to claim 1, wherein the member for transmitting excess tension in the yarn to the micro-contact when said yarn passes in the guide, comprises:

rocker arms (23) articulated around a fixed shaft located in the vicinity of the micro-contact, said rocker bearing on one of its two arms a counterweight capable of sliding on the rocker, and at its end opposite the counterweight, the yarn guide;

an eccentric cam (27) substantially perpendicular to the fixed shaft, mounted idly around said shaft, said rocker being secant with the cam;

and a push member (19) against which rests the cam, for actuating the micro-contact (17) upon rotary movement of the cam.

4. A knitting machine according to claim 1, additionally comprising a positive feed device (10) arranged between said negative feed device (8) and the knitting head (11), the movement of rotation of said positive feed device being driven directly by the rotation of the knitting head.

5. A knitting machine according to claim 1, wherein the knitting machine is a circular knitting machine.

* * * * *